US008971753B2

(12) United States Patent
Ueno

(10) Patent No.: US 8,971,753 B2
(45) Date of Patent: Mar. 3, 2015

(54) PROCESS CARTRIDGE

(75) Inventor: Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/161,274

(22) Filed: Jun. 15, 2011

(65) Prior Publication Data

US 2011/0311265 A1 Dec. 22, 2011

(30) Foreign Application Priority Data

Jun. 18, 2010 (JP) ..... 2010-139961

(51) Int. Cl.
*G03G 21/18* (2006.01)

(52) U.S. Cl.
CPC .... *G03G 21/1832* (2013.01); *G03G 2221/1648* (2013.01)
USPC ..... 399/102; 399/113

(58) Field of Classification Search
USPC ..... 399/25, 102, 112; 220/796, 300, 271
See application file for complete search history.

(56) References Cited

U.S. PATENT DOCUMENTS 5,075,728 A * 12/1991 Kobayashi et al. ..... 399/281
5,488,459 A * 1/1996 Tsuda et al. ..... 399/167
2005/0047824 A1* 3/2005 Kawai ..... 399/119
2007/0009282 A1* 1/2007 Sato et al. ..... 399/90
2007/0206971 A1* 9/2007 Yoshino ..... 399/111
2011/0079413 A1* 4/2011 Masumoto ..... 174/50

FOREIGN PATENT DOCUMENTS

JP 9-127851 A 5/1997
JP 2000-19839 A 1/2000
JP 2003/015391 * 1/2003

* cited by examiner

*Primary Examiner* — Clayton E Laballe
*Assistant Examiner* — Victor Verbitsky
(74) *Attorney, Agent, or Firm* — Canon USA Inc IP Division

(57) ABSTRACT

A process cartridge detachable from an electrophotographic image forming apparatus includes an electrophotographic photosensitive member, a cleaning frame member, a developer bearing member, a development frame member, a flexible sheet member, and a protection member. The electrophotographic photosensitive member forms an electrostatic latent image. The cleaning frame member supports the electrophotographic photosensitive member. The developer bearing member develops the electrostatic latent image using a developer. The development frame member supports the developer bearing member. The flexible sheet member is fixed onto a seating surface with one end side thereof and contacts the developer bearing member with the other end thereof, for preventing leaking of a developer from between the developer bearing member and the development frame member. The protection member is attached to the cleaning frame member, for protecting the electrophotographic photosensitive member. The protection member includes a pressing portion at the back side of the seating surface, for suppressing deformation of the seating surface.

5 Claims, 9 Drawing Sheets

PROCESS CARTRIDGE

BACKGROUND OF THE INVENTION

1. Field of the Invention

The present invention relates to a process cartridge detachable from an electrophotographic image forming apparatus. The process cartridge is a cartridge having an image bearing member, and at least a charging unit and a developing unit formed integrally as a cartridge and detachable from a main body of an image forming apparatus. Here, the image forming apparatus is an apparatus for forming an image on a recording medium using an electrophotographic forming process, and includes, for example, an electrophotographic copying machine, an electrophotographic printer such as a light emitting diode (LED) printer and a laser beam printer, and an electrophotographic facsimile apparatus.

2. Description of the Related Art

Conventionally, in the image forming apparatus using the electrophotographic image forming apparatus, a cartridge method has been adapted. In the cartridge method, the image bearing member and a process unit, which acts on the image bearing member, are integrally formed into a cartridge and the cartridge is detachable from the image forming apparatus. According to the cartridge method, a user can perform maintenance of an apparatus by oneself without depending on a serviceman, so that operability of the apparatus can be remarkably increased. Thus, the cartridge method is widely used in the image forming apparatus.

According to the cartridge method, the operability is increased, and it becomes possible for a user to easily perform the maintenance of the electrophotographic image forming apparatus by oneself. Thus, the cartridge method is widely used in the image forming apparatus.

In many cartridges, a detachable protection member is adopted for protecting a surface of a photosensitive drum from light, dust, fluff, and scratches at a time of shipping (for example, refer to FIG. 4 in Japanese Application Laid-Open No. 9-127851). A user detaches the protection member before mounting the cartridge to an image forming apparatus, and mounts the cartridge to an image forming apparatus as it is.

Further, as a countermeasure of toner leak at a time of shipping, Japanese Patent Laid-Open No. 2000-19839 discusses, in FIG. 6, a configuration in which a sealing member is adhered to the protection member itself, and this configuration is adopted in some cartridges.

Further, recently, for increasing operability, a configuration for eliminating a toner seal, which closes an opening for supplying a toner to the developing unit has been adopted. This configuration is realized by removing the seal at a time of exchanging a cartridge. To realize this configuration, metal parts are added for increasing strength of a seating surface to which a flexible sheet member is fixed. In this case, the flexible sheet acts to prevent toner leak at a space between a development roller and a development case frame member.

The protection members like the conventional examples protect only the surface of the photosensitive drum, and there is a possibility that toner leak and toner dispersion come about near the development roller by a physical distribution at a time of shipping.

In a toner seal-less configuration, countermeasures against the toner leak and the toner dispersion is needed only at a time of the physical distribution. Thus, implementing the countermeasure by adding metal parts like the conventional example leads to a cost rise and may become a superfluous measure. Further, like the configuration discussed in Japanese Patent Laid-Open No. 2000-19839, a configuration of providing the sealing member to the protection member also causes a cost rise.

Further, when a process cartridge, which has reached the end of useful life, is collected, it is necessary to attach again the protection member to the process cartridge, for preventing the waste toner leak from a waste toner chamber.

SUMMARY OF THE INVENTION

The present invention is directed to provide a process cartridge which can prevent toner leak and toner dispersion in a period from shipping to an attachment to an image forming apparatus, or in a period from end of useful life to a collection of the cartridge.

According to an aspect of the present invention, a process cartridge detachable from an electrophotographic image forming apparatus includes an electrophotographic photosensitive member, a cleaning frame member, a developer bearing member, a development frame member, a flexible sheet member, and a protection member. The electrophotographic photosensitive member forms an electrostatic latent image. The cleaning frame member supports the electrophotographic photosensitive member. The developer bearing member develops the electrostatic latent image using a developer. The development frame member supports the developer bearing member. The flexible sheet member is for preventing leak of a developer from between the developer bearing member and the developer frame member. One end side of the flexible sheet member is fixed onto a seating surface of the developer frame member and the other end side contacts to the developer bearing member. The protection member is attached to the cleaning frame member for protecting the electrophotographic photosensitive member and is detached when the process cartridge is mounted to the electrophotographic image forming apparatus. The protection member includes a pressing portion contacting to a back side of the seating surface for suppressing deformation of the seating surface.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
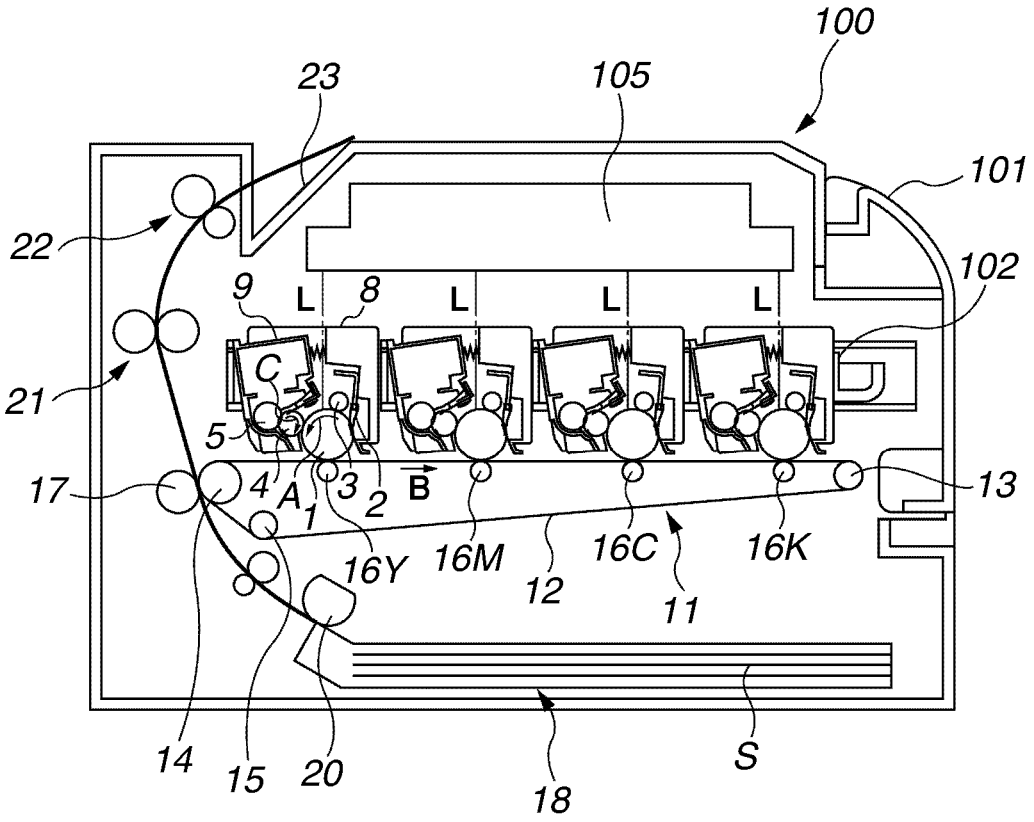
FIG. 1 is a schematic cross-sectional view illustrating a color electrophotographic image forming apparatus.

At first, a schematic configuration of the color electrophotographic image forming apparatus will be described using FIG. 1. FIG. 1 is a schematic cross-sectional view illustrating a color electrophotographic image forming apparatus (hereinafter referred to as an image forming apparatus) according to the present exemplary embodiment. The main body of image forming apparatus 100 is a four colors full color laser printer and performs color image forming on a recording medium S. The main body of image forming apparatus 100 adopts a process cartridge method and the process cartridge is detachable from the main body of image forming apparatus 100. The main body of image forming apparatus 100 forms a color image on the recording medium S.

In the following description, concerning the main body of image forming apparatus 100, a side in which an opening/closing door 101 is provided is set to a front face and an opposite face to the front face is set to aback face. Right and left are set as viewed from the front face side of the main body of image forming apparatus 100.

In the main body of image forming apparatus 100, 4 process cartridges P (PY, PM, PC, PK) can be arranged in a horizontal direction. Each process cartridge P is housed in a cartridge housing portion 102 in the main body of image forming apparatus 100. The process cartridges P are exchangeable. When the process cartridge P is exchanged, a user opens the opening/closing door 101 in the image forming apparatus main body 100, pulls out a pullout member 102 in a front face direction, and performs attachment/detachment of each cartridge P.

Each process cartridge P includes a similar electrophotographic process mechanism, and a color of a developer (hereinafter referred to as a toner) and a filling amount of the toner are different from each other. To the process cartridges P positioned in the pullout member 102, rotation driving force is transmitted from a drive input portion (not illustrated) in the image forming apparatus main body 100. Further, to the process cartridges P, bias voltage (charging bias and developing bias) (not illustrated) is supplied from the image forming apparatus main body 100.

Figure 2:
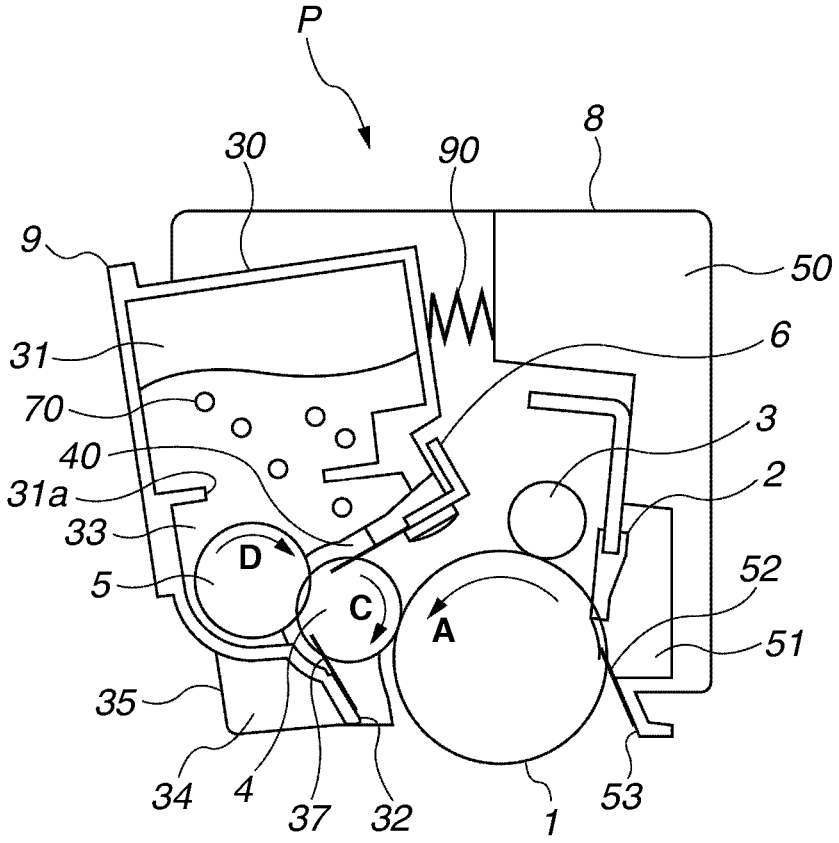
FIG. 2 is a schematic cross-sectional view illustrating the process cartridge.

As illustrated in FIG. 2, each process cartridge P includes an electrophotographic photosensitive drum 1 (hereinafter referred to as a photosensitive drum) and a photosensitive drum unit 8 including a charging unit which is a process unit acting to the photosensitive drum 1 and a cleaning unit. Further, each process cartridge P includes a development device 9 including a developer bearing member which develops an electrostatic latent image on the photosensitive drum 1. The photosensitive drum unit 8 and the development device 9 are connected to each other. Further, a charging roller 3 as a charging unit, a cleaning blade 2 as a cleaning unit, and a development roller 4 as a developer bearing unit are used. More detailed configuration of the process cartridge will be described later.

A first process cartridge PY houses a yellow (Y) toner in a development container and forms a toner image of a yellow color on a surface of the photosensitive drum 1. A second process cartridge PM houses a magenta (M) toner in a development container and forms a toner image of a magenta color on a surface of the photosensitive drum 1. A third process cartridge PC houses a cyan (C) toner in a development container and forms a toner image of a cyan color on a surface of the photosensitive drum 1. A fourth process cartridge PK houses a black (K) toner in a development container and forms a toner image of a black color on a surface of the photosensitive drum 1.

On an upper side of the process cartridges P (PY, PM, PC, and PK), a scanner unit 105 which is an exposure unit is provided. The scanner unit 105 output laser light L corresponding to image information. Then, the laser light L exposes a surface of the photosensitive drum 1 of the cartridge P.

On a lower side of the process cartridges P (PY, PM, PC, and PK), an intermediate transfer belt unit 11 which is a transfer member is provided. The intermediate transfer belt unit 11 includes an endless transfer belt 12 having flexibility, a drive roller 13 which rotates the transfer belt 12, a turn roller 14 and tension roller 15 which stretch the transfer belt 12. A lower surface of the photosensitive drum 1 contacts an upper surface of the transfer belt 12. The contact portion is a primary transfer portion. On an inner side of the transfer belt 12, primary transfer rollers 16 (16Y, 16M, 16C, and 16K) are provided, opposing to the photosensitive drums 1. A secondary transfer roller 17 is provided, contacting the turn roller 14 via the transfer belt 12. The contact portion of the transfer belt 12 and the secondary transfer roller 17 is a secondary transfer portion.

On a lower side of the intermediate transfer belt unit 11, a feeding unit 18 is provided. The feeding unit 18 includes a sheet feeding tray 18 stacking and storing the recording medium S and a sheet feeding roller 20.

On an upper side of the back side in the image forming apparatus main body 100, a fixing unit 21 and a discharge unit 22 are provided. An upper face of the image forming apparatus main body 100 is a discharge tray 23.

The each cartridge P (PY, PM, PC, and PK) housed in the pullout member 102 is pressed from upper side by a press mechanism (not illustrated) on the image forming apparatus main body 100 side and fixed to a positioning portion (not illustrated) on the image forming apparatus main body 100 side. Further, a drive output unit on the image forming apparatus main body 100 side connects to a drive input unit of the each cartridge P (not illustrated). Further, an electric power supply system (not illustrated) on the image forming apparatus 100 side conducts to an input electrical contact on the each cartridge P side.

The operation for forming a full color image is as follows. In FIG. 1, the photosensitive drums 1 of each process cartridge P (PY, PM, PC, and PK) of a first to a fourth are rotationally driven in an arrow direction (A direction in FIG. 1) at a predetermined speed. The transfer belt 12 is also rotationally driven in an arrow direction (B direction in FIG. 1) at a speed corresponding to the speed of the photosensitive drums 1. The scanner unit 105 is also driven. Synchronizing these dives, in each process cartridge P, the charging roller 3 uniformly charges the surfaces of the photosensitive drum 1 in predetermined polarity and potential.

The scanner unit 105 exposes the surface of each photosensitive drum 1 by the laser light L corresponding to an image signal of each color. With this operation, an electrostatic latent image corresponding to the image signal of the corresponded color is formed on the surface of each photosensitive drum 1. The formed electrostatic latent image is developed by the development roller 4 rotationally driven at a predetermined rate in an arrow C direction.

By the aforementioned electrophotographic image forming process operation, a toner image with yellow color corresponding to a yellow component of full color image is formed on the photosensitive drum 1 in the first process cartridge PY. Then, the toner image is primary transferred onto the transfer belt 12.

Similarly, a toner image with magenta color corresponding to a magenta component of full color image is formed on the photosensitive drum 1 in the second process cartridge PM. Then, the toner image is primary transferred, and is superimposed on the toner image of yellow color which is already transferred onto the transfer belt 12.

Similarly, a toner image with cyan color corresponding to a cyan component of full color image is formed on the photosensitive drum 1 in the third process cartridge PC. Then, the toner image is primary transferred, and superimposed on the toner images of yellow color+magenta color which are already transferred onto the transfer belt 12.

Similarly, a black color toner image corresponding to a black component of full color image is formed on the photosensitive drum 1 in the fourth process cartridge PK.

Then, the toner image of black color is primary transferred, and is superimposed on the toner images of yellow color+magenta color,+cyan color which are already transferred onto the transfer belt 12.

With these processes, an unfixed toner image with four colors full color of yellow color+magenta color+cyan color+ and black color is formed onto the transfer belt 12.

Meanwhile, the recording media S is fed one by one with being separated from each other at predetermined control timing. The recording media S is introduced to a secondary transfer portion at a predetermined control timing. At the secondary transfer portion, the secondary transfer roller 17 abuts on the transfer belt 12. According to this process, in the process in which the recording medium S is conveyed to the secondary transfer portion, the toner image in which four colors are superimposed on the transfer belt 12 is transferred collectively onto the recording medium S successively.

The recording medium S is separated from the surface of the transfer belt 12 and introduced to a fixing unit 21. Then, the recording medium S is heated and pressed at the fixing nip portion. By this process, each color toner image is fixed to the recording medium S. Then, the recording medium S goes out from the fixing unit 21 and is discharged, as a full color image formed sheet, on a discharge sheet tray 23 by the discharging unit 22.

Figure 3:
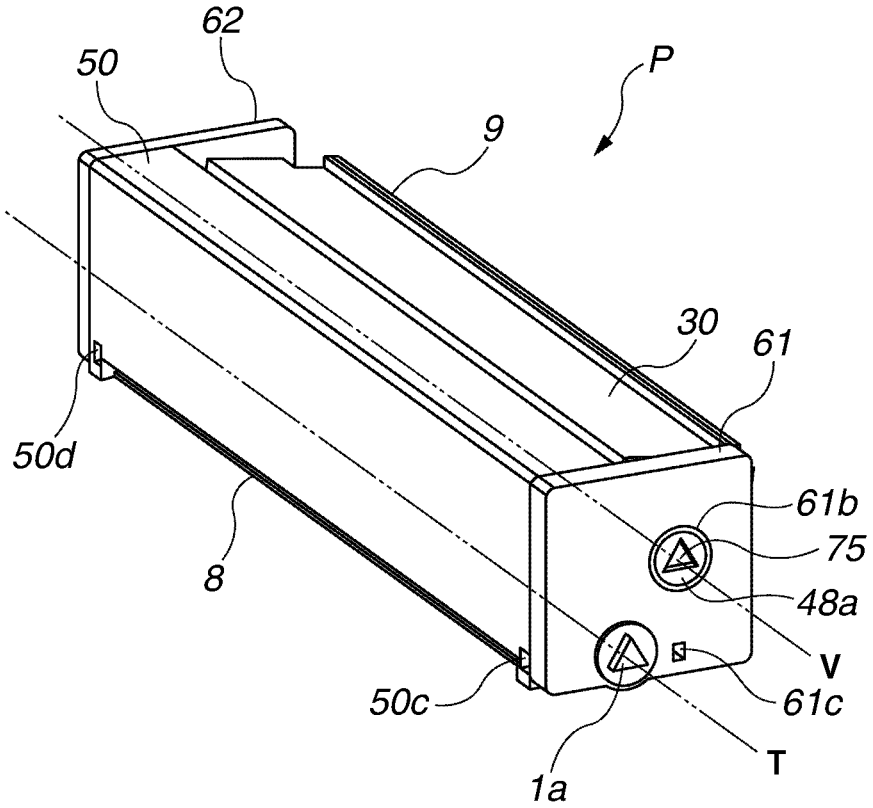
FIG. 3 is a schematic perspective view illustrating the process cartridge.
Figure 4:
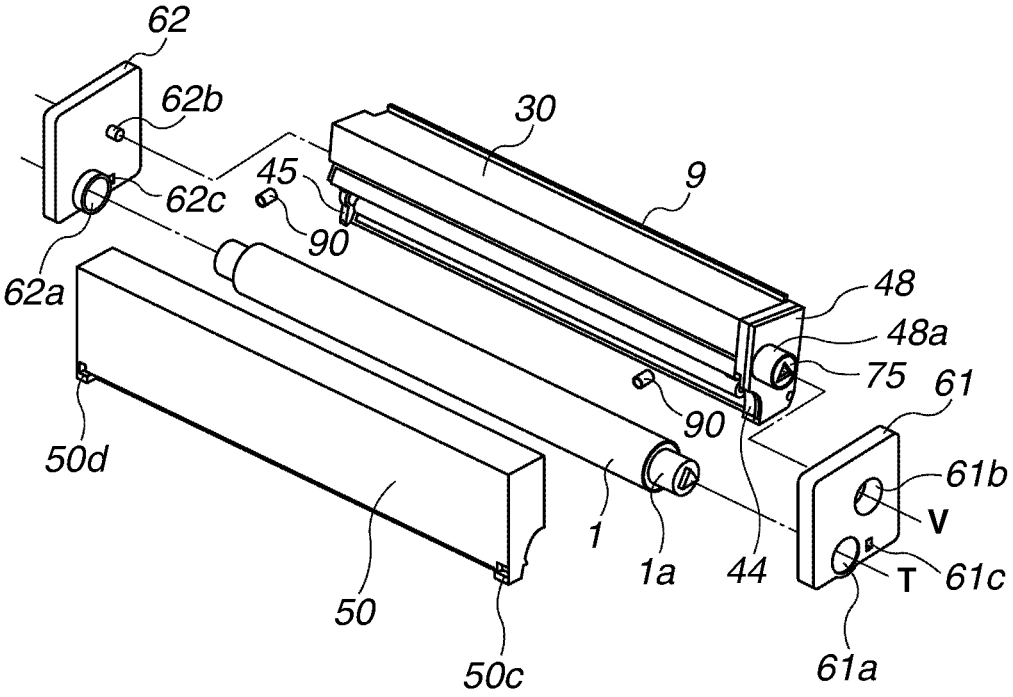
FIG. 4 is schematic exploded perspective view illustrating the process cartridge.

Then, the process cartridge P will be described using FIG. 2, FIG. 3, and FIG. 4. FIG. 2 is a schematic cross-sectional view illustrating the process cartridges P (PY, PM, PC, and PK). FIG. 3 is a schematic perspective view illustrating the process cartridges P (PY, PM, PC, and PK). FIG. 4 is an exploded perspective view illustrating the process cartridges P (PY, PM, PC, and PK).

As illustrated in FIG. 3, the process cartridges P (PY, PM, PC, and PK) have a oblong shape with a longitudinal direction which is a rotation axis line T direction of the photosensitive drum 1. As viewed from the front side of the image forming apparatus main body, a right side is a drive side and a left side is a non-drive side. The cartridge P includes a photosensitive drum unit 8, development device 9, a drive side cover member 61, and non-drive side cover member 62.

The photosensitive drum unit 8 includes a cleaning frame member 50 including a cleaning blade 2 and a scooping sheet 52, a photosensitive drum 1, and a charging roller 3.

As illustrated in FIG. 3 and FIG. 4, the photosensitive drum 1 is rotatably supported by a photosensitive drum support portion 61*a* of the drive side cover member 61 on the drive side, and by a photosensitive drum support portion 62*a* on a rotation axis line T of the non-drive side cover member 62 on the non-drive side. A drum drive coupling 1*a* is a photosensitive drum drive input portion. At an end of the drive side of the photosensitive drum 1, the drum drive coupling (drive transmission portion) 1*a* is attached coaxially with the photosensitive drum 1. A coupling which is a drum drive output portion (not illustrated) engages to the drum drive coupling 1*a*. Then, driving force of a drive motor of the main body of apparatus (not illustrated) is transmitted and the photosensitive drum 1 is rotationally driven in the A direction (in FIG. 1 and FIG. 2) at a predetermined speed.

The charging roller 3 is a charging member of a contact charging type which contacts the photosensitive drum 1 and rotates. The charging roller 3 is provided by causing the axis ends thereof on the drive side and the non-drive side to be rotationally supported via bearing portions (not illustrated) which are provided between side plates of the cleaning frame member 50.

The cleaning blade 2 which is a cleaning member has an elastic rubber blade and removes the toner remaining on the photosensitive drum 1. The remaining toner, which is removed from periphery surface of the photosensitive drum 1 by the cleaning blade 2, is guided by the scooping sheet 52 which is a flexible sheet member and stored in a waste toner chamber 51 positioned in the cleaning frame member 50.

The scooping sheet 52 is fixed onto a seating surface 53, which is provided in the cleaning frame member 50, by attaching one end thereof using a double-stick tape. Another one end contacts to the photosensitive drum 1. A contact direction of the scooping sheet 52 is set to become a forward direction to the rotation direction A of the photosensitive drum 1. The reason for this is that the remained toner on the photosensitive drum 1 rotating in the arrow A direction passes through the contact portion of the photosensitive drum 1 and the scooping sheet 52 but the scooping sheet 52 prevents the remained toner removed from the periphery surface of the photosensitive drum 1 by the cleaning blade 2 from moving in a opposite direction of the rotation direction A.

As illustrated in FIG. 3, the development device 9 has an oblong shape with a longitudinal direction which is a rotation axis direction of the development roller 4, which is the developer bearing member. As illustrated in FIG. 2, the development device 9 includes, other than the development roller 4, a development frame member 30, a development blade 6, a developer supply roller 5, an end seal member 40, and a gush prevention sheet 37 which is a flexible sheet member. The developer supply roller 5 includes a core member made of a metal and a cylindrical elastic member made of urethane foam. The developer supply roller 5 is provided in a development chamber 33 facing an opening 31*a* in the toner chamber 31, and abuts on the development roller 4. The core members of the development roller 4 and the developer supply roller 5 are respectively arranged in the development chamber 33, and both ends of each core member are rotatably supported by a bearing member 44 and 45 attached to both sides of the drive side and the non-drive side of the development frame member 30.

Coupling (not illustrated), which is development drive output portions on the main body of apparatus 100 side, engage to drive output unit 75, and transmit driving force of the drive motor (not illustrated) of the main body of apparatus 100 to the development roller 4 and the developer supply roller 5. Each roller driven rotates in C direction or D direction at a predetermined speed.

At a time of developing, the developer supply roller 5 rotates, and friction against the development roller 4 causes a toner 70 in the toner chamber 31 which is provided in the development frame member 30 to be applied on the development roller 4 in the development chamber 33. The development blade 6 is provided, whose end portion thereof abuts on the development roller 4 in a counter direction to the rotation direction of the development roller 4. The toner applied on the development roller 4 is charged by the development blade 6 with rotation of the development roller 4 and is controlled to be a predetermined toner thin layer. Then, at a contact portion between the development roller 4 and the photosensitive drum 1, the toner on the development roller 4 adheres to an electrostatic latent image on the photosensitive drum 1 and develops the latent image.

The toner not contributing to the development and remaining on the development roller 4 is returned in the development chamber 33 by the rotation of the development roller 4, exfoliated by the development roller at a friction portion with the developer supply roller 5, and collected. The collected toner is mixed with the remaining toner in the development chamber 33.

At both ends of the opening of the development room 33, end sealing members 40 are provided in a state of abutting on the development roller 4, and prevent toner from leaking from the gaps between the development chamber 33, and the development blade 6 and the development roller 4. Further, in the longitudinal direction of opening portion of the development chamber 33, the gush prevention sheet 37 is provided to abut on the development roller 4 and prevents toner from leaking from between the development chamber 33 and the development roller 4. More specifically, at this place, one end side of the gush prevention sheet 37 adheres and is fixed onto the seating surface 32 provided in the development frame member 30 by a double-stick tape. The other end side of the gush prevention sheet 37 abuts on the development roller 4.

Further, as illustrated in FIG. 3 and FIG. 4, the development device 9 is swingably supported between a drive side cover member 61 and a non-drive side cover member 62, centering around an axis line V parallel to a drum axis line T. On the drive side of the development device 9, a cylinder portion 48*a* of a development side cover 48 is rotatably supported by a cylinder bearing hole 61*b* of the drive side cover member 61 and becomes a swing center. On the non-drive side, a side face hole (not illustrated) of the development frame member 30 is rotatably supported by an axis 62*b* of the non-drive side cover member 62 and becomes a swing center. More specifically, the development device 9 is rotatably connected to the photosensitive drum unit 8 and always biased by a pressure spring 90 which is a biasing member, so as to rotate the development roller 4 in a direction of contacting the photosensitive drum 1. The pressure springs 90 are provided at both sides of the drive side and the non-drive side. Specifically, the development device 9 can move between a contact position for contacting the development roller 4 to the photosensitive drum 1 and a separation position for separating the development roller 4 from the photosensitive drum 1.

A protection member (hereinafter referred to as a drum protection cover), which is an exemplary embodiment of the present invention will be described using FIG. 5, FIG. 6, FIG. 7, FIG. 8, and FIG. 9.

Figure 5:
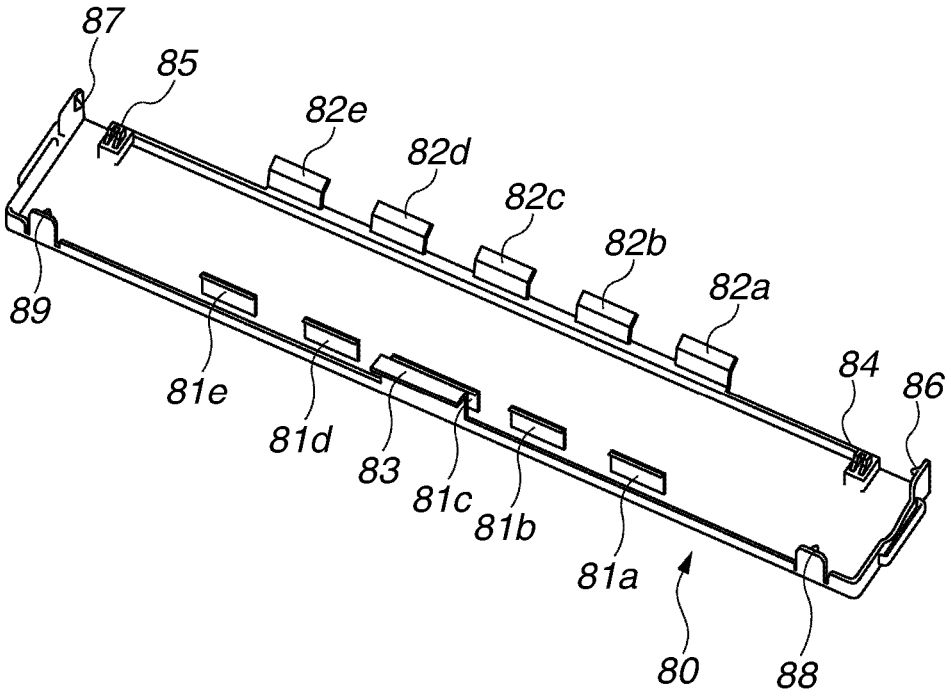
FIG. 5 is a schematic perspective view illustrating a drum protection cover.
Figure 6:
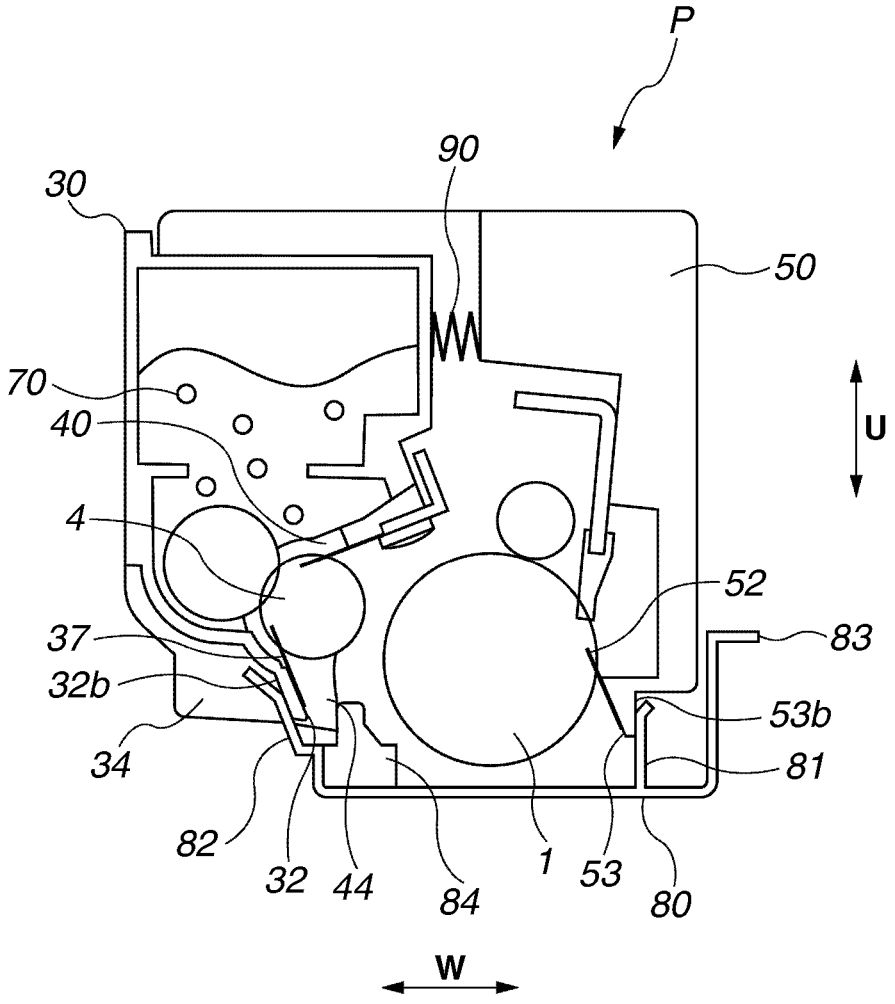
FIG. 6 is schematic cross-sectional view illustrating the process cartridge when the drum protection cover is mounted.
Figure 7:
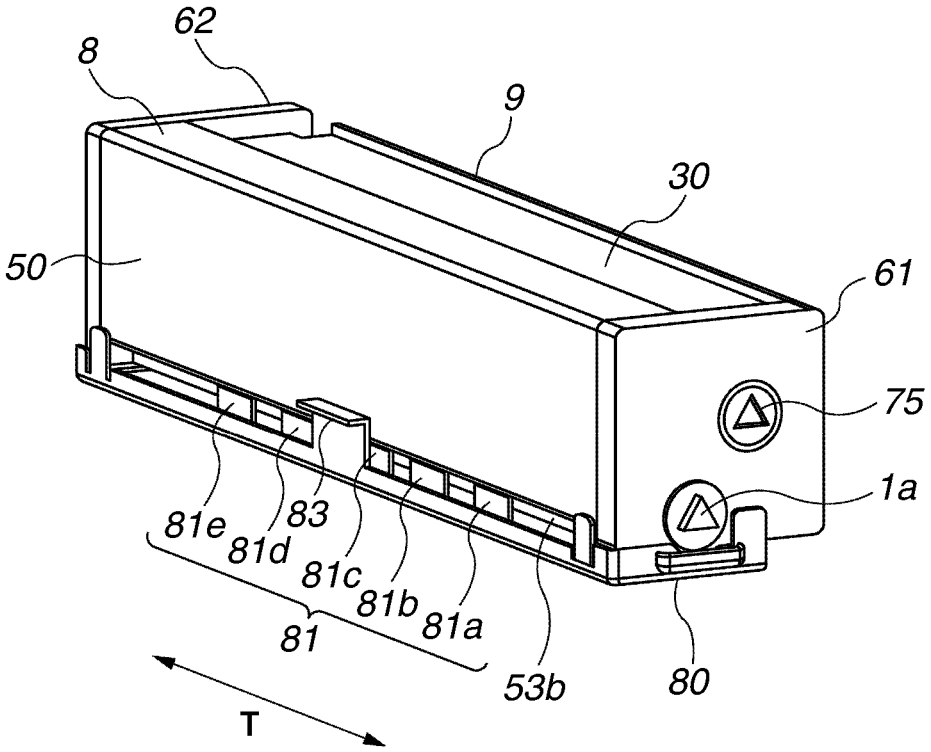
FIG. 7 is a schematic perspective view illustrating the process cartridge viewed from a photosensitive drum unit side when the drum protection cover is mounted.
Figure 8:
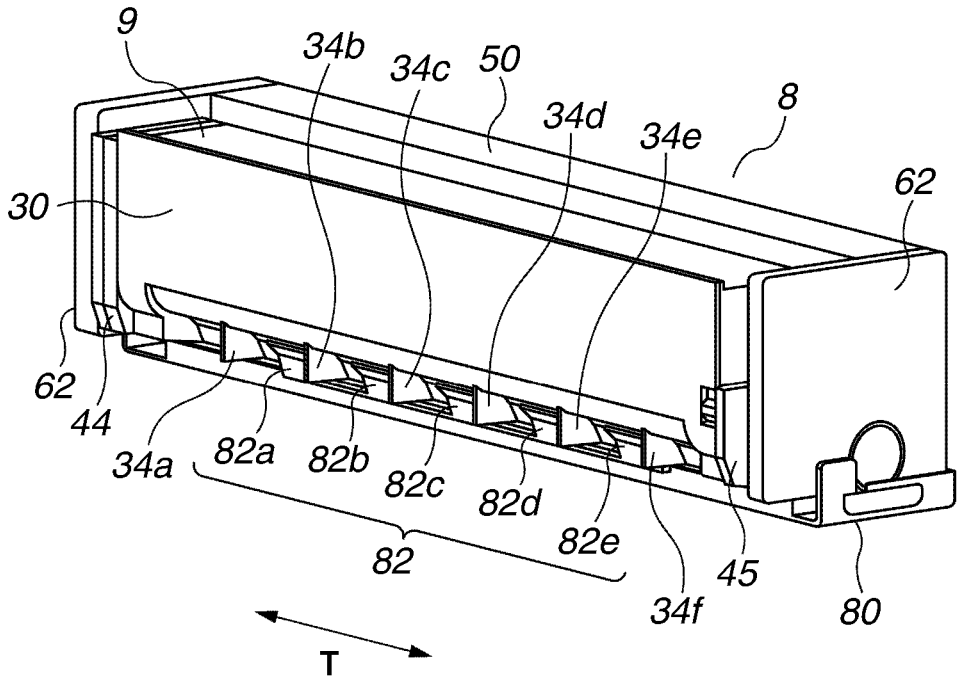
FIG. 8 a schematic perspective view illustrating the process cartridge viewed from a development apparatus side when the drum protection cover is mounted.
Figure 9:
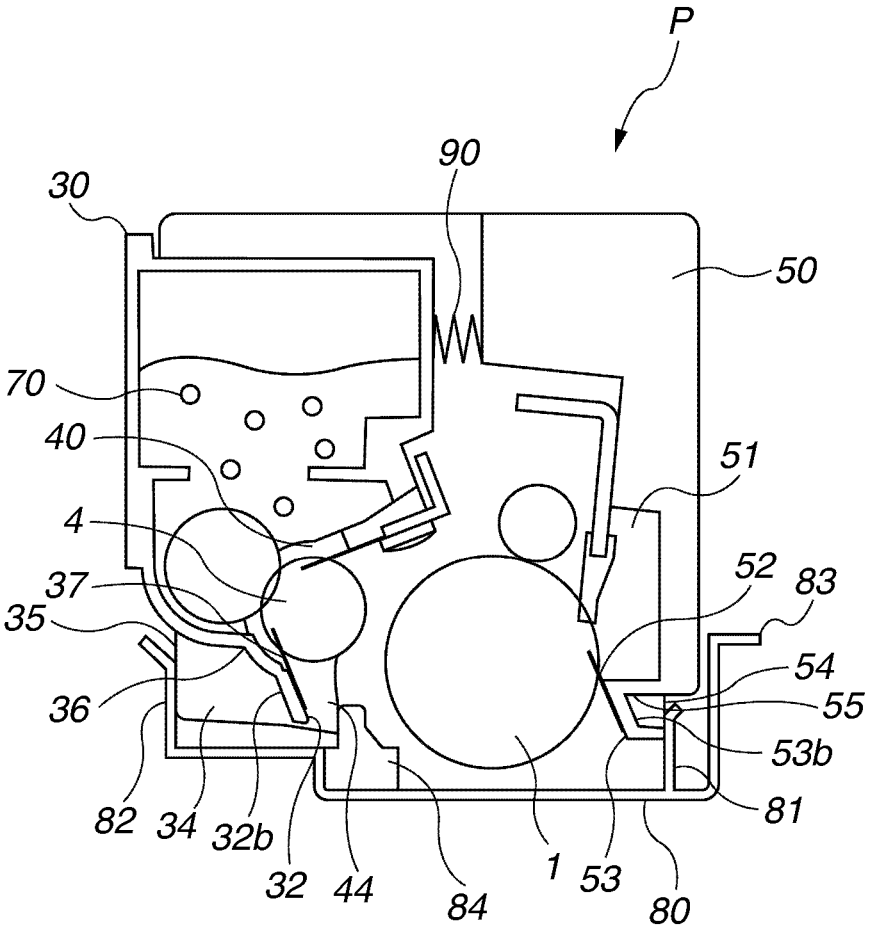
FIG. 9 is a schematic cross-sectional view illustrating the process cartridge when the drum protection cover is mounted.

FIG. 5 is a schematic perspective view illustrating the drum protection cover. FIG. 6 is a cross-sectional view illustrating a process cartridge when the drum protection cover is mounted. FIG. 7 is a schematic perspective view illustrating the process cartridge when the drum protection cover is mounted, as viewed from the photosensitive drum unit side. FIG. 8 is a schematic perspective view illustrating the process cartridge when the drum protection cover is mounted, as viewed from the development device side. FIG. 9 is a schematic cross-sectional view illustrating the process cartridge when the drum protection cover is mounted.

The drum protection cover will be described using FIG. 4 and FIG. 5. The drum protection cover 80 is made of a molded resin and typically protects a surface of a photosensitive drum from light, dust, fluff, and cracks at a time of shipping and collecting.

When a user uses the process cartridge P by mounting it in the main body of image forming apparatus 100, the user can remove the drum protection cover 80 by pushing downward a handhold portion 83.

A fixing method of the drum protection cover 80 to the process cartridge P will be described. An engaging portion 86 of the drum protection cover 80 engages with an engaging hole 61*c* of a drive side cover member 61 and further, an engaging portion 87 engages with an engaging hole 62*c* of a non-drive side cover member 62 respectively, so that a position in a short side direction (W direction in FIG. 6) is determined. Furthermore, the engaging portions 88 and 89 engage with engaging holes 50*c* and 50*d* of the cleaning frame member 50 respectively, so that a position in a up and down direction (U direction in FIG. 6) is determined. As another exemplary embodiment apart from the present exemplary embodiment, only a part supporting the photosensitive drum 1 can be configured with a cover member, and all of the aforementioned engaging holes can be provided in the cleaning frame member 50.

In the present exemplary embodiment, a shipping form in a state in which the development roller 4 and the photosensitive drum 1 are separated is adopted. As illustrated in FIG. 6, when the drum protection cover 80 is mounted, development position determination portions 84 and 85 abut on a part of bearing members 44 and 45 of the development device 9. In this case, the development device 9 is held in a state in which the development device 9 is rotated in a clockwise direction by a predetermined angle centering around a swing center, so that a state in which the photosensitive drum 1 and the development roller 4 are separated is realized. In another words, the development device 9 is positioned at a separation position.

The separation state in the present exemplary embodiment is a state in which the development position determination portions 84 and 85, and the photosensitive drum 1 are not in contact with each other. However, the development position determination portions 84 and 85 and the photosensitive drum 1 can be separated in a state in which the development position determination portions 84 and 85 are in contact with both the development drum 1 and the bearing members 44 and 45.

Conventionally, inner pressure of a container increases by deformation of a gush prevention sheet seating surface or a scooping sheet seating surface. The deformation is generated by impact at a time of shipping, collecting, and transporting. Thus, by the increased inner pressure, there is a possibility that toner leaks from a part between the gush prevention sheet and the development roller, and a part between the scooping sheet and the development drum, where the abutment pressure is small.

Therefore, as for a countermeasure against the toner leak, it is simple and effective to give a function for preventing deformation of these seating surfaces of each sheet member to the drum protection cover 80, which is mounted only at a time of shipping and collecting.

As illustrated in FIG. 8, as for the countermeasure against deformation of the gush prevention sheet seating surface 32, the development frame member 30 in the development apparatus 9 includes a plurality of reinforcing ribs 34 provided on the back side 32*b* of the seating surface. These reinforcing ribs extend in a vertical or a cross direction with respect to the back side of the seat face 32*b*, and are provided in line in a development roller axis direction (T direction in FIG. 8). In the present exemplary embodiment, pressing portions 82 directly abuts on the back side 32*b* of the seating surface between each rib. More specifically, a pressing portion 82*a* is provided between the ribs 34*a* and 34*b*, a pressing portion 82*b* is provided between the ribs 34*b* and 34*c*, a pressing portion 82*c* is provided between the ribs 34*c* and 34*d*, a pressing portion 82*d* is provided between the ribs 34*d* and 34*e*, and a pressing portion 82*e* is provided between 34*e* and 34*f*. The pressing portion 82 is an elastic portion which is elastic deformable, so that a size variation of the back side 32*b* of the seating surface can be compensated.

In the photosensitive drum unit 8, as illustrated in FIG. 7, a pressing portion 81 also abuts on a back side 53*b* of the seating surface as a countermeasure to deformation of the scooping sheet face 53. Since the pressing portion 81 is an elastic portion, a size variation at the back side 53*b* of the seat is absorbable. In the present exemplary embodiment, although the pressing portion 81 is divided into 81*a*, 81*b*, 81*c*, 81*d*, and 81*e*, if the pressing portions have elasticity, these portions can be integrally formed.

In the present exemplary embodiment, ribs are not provided at the back side 53*b* of the scooping sheet face 53. However, even when the ribs are provided, the similar effect to the development device 9 can be obtained by allowing pressing portions 81*a*, 81*b*, 81*c*, 81*d*, and 8*e* to abut on corresponding back side 53*b* of the seating surface between each rib.

In the present exemplary embodiment, the pressing portions 82 are provided between each rib. However, as illustrated in FIG. 9, the similar effect can be obtained by allowing the pressing portion 82 to abut on an end portion 35 of each rib 34 directly provided from the back side 32*b* of the seating surface. In this case, the smaller an interval of a plurality of ribs 34 is, the more the effect increases (the second exemplary embodiment).

Further, as described above, when the back side 32*b* of the seating surface is not directly pressed, it is effective to allow the pressing portion 82 to abut on the more top end side of the seating surface than a root 36 of apart which forms the seating surface 32.

In the photosensitive drum unit 8, as illustrated in FIG. 9, the similar effect is obtained by allowing the pressing portion 81 to abut on a rib top surface 54. When the back side 53*b* of the seating surface is not directly pressed, it is effective to abut the pressing portion 81 on the more top end side of the seating surface than a root 55 of apart which forms the seating surface 53.

In this case, it is not necessary to form a plurality of pressing portions, adjusting gaps between a plurality of ribs, so that freedom of a position of the pressing portion and number of the pressing portion increases.

In the present exemplary embodiment, the process cartridge has the configuration which is integrated by the photosensitive drum unit 8 at least including the photosensitive drum 1 and charging roller 3, and the development device 9 at least including the development roller 4. However, even when the photosensitive drum unit 8 and the development device 9 are configured independently, the similar effect to the present exemplary embodiment can be obtained.

For example, in a case of an independent development device, the following configuration is realized. Specifically, the protection cover of the development roller is positioned to the bearing member 45 and the development side cover 48 in the development device 9, and the pressing portion abuts on the gush prevention sheet seating surface. In this case, the development protection cover can be positioned with respect to the development frame member 50.

Further, in a case of an independent photosensitive drum unit, the drum protection cover is positioned with respect to the photosensitive drum unit, and the pressing portion abuts on the scooping sheet seat face.

In addition, the present exemplary embodiment is described on an assumption that the photosensitive drum 1 and the development roller 4 are separated. However, the similar effect is also obtained in the state in which the photosensitive drum 1 and the development roller 4 are not separated.

For example, as described above, the drum protection cover 80 is positioned by the cleaning frame member 50, the drive side cover member 61, and the non-drive side cover member 62 which configure the photosensitive unit 8. In the state in which the photosensitive drum 1 and the development roller 4 are not separated, the development position determination portions 84 and 85 are not necessary in the drum protection cover 80. In this configuration, the development device 9 is rotated centering around the swing center, and the development roller 4 abuts on the photosensitive drum 1, so that the position of the development device 9 is determined. Then, the pressing portion 82 of the drum protection cover 80 abuts on the back side 32*b* of the seating surface of the gush prevention sheet seating surface 32.

According to the above description, the process cartridge according to the present invention obtains the following effects.

(1) At a time of shipping, by attaching a protection member, the process cartridge can suppress deformation of a seating surface which fixes a flexible sheet member, and decrease toner leak and toner dispersion as much as possible.

(2) At a time of collecting a used cartridge, by attaching a protection member, the process cartridge can suppress deformation of a seating surface which fixes a flexible sheet member, and decrease toner leak and toner dispersion as much as possible.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-139961 filed Jun. 18, 2010, which is hereby incorporated by reference herein in its entirety.

What is claimed is:

1. A process cartridge detachable from an electrophotographic image forming apparatus, comprising:

an electrophotographic photosensitive member for forming an electrostatic latent image;

a cleaning frame member for supporting the electrophotographic photosensitive member;

a developer bearing member for developing the electrostatic latent image using a developer;

a development frame member for supporting the developer bearing member;

a flexible sheet member for preventing leaking of a developer from between the developer bearing member and the development frame member, the flexible sheet being fixed onto a seating surface provided on the development frame member with one end side thereof, and contacting to the developer bearing member with the other end side thereof;

a plurality of reinforcing ribs provided on the development frame member and extending in a direction crossing the seating surface; and a protection member provided on the cleaning frame member, for protecting the electrophotographic photosensitive member, and being removed at a time when the process cartridge is mounted on the electrophotographic image forming apparatus, wherein the protection member includes a pressing portion abutting on the development frame member, for suppressing deformation of the seating surface, and the plurality of reinforcing ribs are provided in line at a back side of the seating surface in an axial line direction of the developer bearing member, and wherein the pressing portion abuts on the plurality of the reinforcing rib.

2. The process cartridge according to claim 1, wherein the development frame member is rotatably provided on the cleaning frame member, has a contact position and a separation position, and includes a position determination portion, wherein at the contact position, the developer bearing member contacts the electrophotographic photosensitive member and, at the separation position, the developer bearing member separates from the electrophotographic photosensitive member, and wherein the position determination portion causes the developer bearing member to be positioned at the separation position when the protection member is attached to the cleaning frame member.

3. The process cartridge according to claim 1, wherein the pressing portion is elastically deformable.

4. A process cartridge detachable from an electrophotographic image forming apparatus comprising:

an electrophotographic photosensitive member for forming an electrostatic latent image;

a cleaning frame member for supporting the electrophotographic photosensitive member;

a cleaning member for removing a developer from the electrophotographic photosensitive member;

a flexible sheet member for guiding a developer removed by the cleaning member inside the cleaning frame member, wherein one end side of the flexible sheet member is fixed onto a seating surface provided in the cleaning frame member and the other end side contact the electrophotographic photosensitive member;

a plurality of reinforcing ribs provided on the cleaning frame member and extending in a direction crossing the seating surface; and a protection member provided at the cleaning frame member for protecting the electrophotographic photosensitive member, and being removed at a time when the process cartridge is mounted on the electrophotographic image forming apparatus, wherein the protection member includes a pressing portion abutting on the cleaning member frame, for suppressing deformation of the seating surface, wherein the plurality of reinforcing ribs are provided in line at a back side of the seating surface in an axial line direction of the electrophotographic photosensitive member, and wherein the pressing portion abuts on the reinforcing rib.

5. The process cartridge according to claim 4, wherein the pressing portion is elastically deformable.

* * * * *